US008305339B2

(12) United States Patent
Baba et al.

(10) Patent No.: US 8,305,339 B2
(45) Date of Patent: Nov. 6, 2012

(54) IMAGE PROCESSING APPARATUS AND IMAGE DISPLAYING APPARATUS

(75) Inventors: Masahiro Baba, Yokohama (JP); Ryosuke Nonaka, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/418,482

(22) Filed: Mar. 13, 2012

(65) Prior Publication Data

US 2012/0182333 A1 Jul. 19, 2012

Related U.S. Application Data

(63) Continuation of application No. PCT/JP2009/004783, filed on Sep. 22, 2009.

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 2007/0152949 | A1* | 7/2007 | Sakai | 345/102 |
| 2008/0074372 | A1 | 3/2008 | Baba et al. | |
| 2008/0180373 | A1 | 7/2008 | Mori | |
| 2011/0025728 | A1 | 2/2011 | Baba et al. | |

FOREIGN PATENT DOCUMENTS

| | | |
|---|---|---|
| JP | 2007-228474 | 9/2007 |
| JP | 2008-070683 | 3/2008 |
| JP | 2008-076755 | 4/2008 |
| JP | 2008-107719 | 5/2008 |

OTHER PUBLICATIONS

International Search Report for International Application No. PCT/JP2009/004783 mailed on Jan. 12, 2010.

* cited by examiner

*Primary Examiner* — Kevin M Nguyen
(74) *Attorney, Agent, or Firm* — Turocy & Watson, LLP

(57) ABSTRACT

There is provided an image displaying apparatus in which a light-source luminance calculator calculates light-source luminance of the light emitted by a backlight based on pixel values of an input image, a cumulative light-emission amount calculator calculates a cumulative light-emission amount by summing up light-source luminance for an arbitrary period for which an image is displayed at a time before the input image is displayed, the cumulative light-emission amount is compared with a reference light-emission amount determined in advance, and if the difference between the cumulative light-emission amount and the reference light-emission amount is smaller than a reference, a light-source luminance correcting unit corrects the light-source luminance to a smaller value to obtain corrected light-source luminance corrected.

6 Claims, 14 Drawing Sheets

IMAGE PROCESSING APPARATUS AND IMAGE DISPLAYING APPARATUS

CROSS REFERENCE TO RELATED APPLICATIONS

This application is a continuation of International Application No. PCT/JP2009/004783, filed on Sep. 22, 2009, the entire contents of which is hereby incorporated by reference.

FIELD

The present invention relates to an image processing apparatus and an image displaying apparatus.

BACKGROUND

Recently, an image displaying apparatus such as a liquid crystal display apparatus provided with a light source and a light modulating element, which modulates the intensity of the light from the light source, has been widely used. However, in the conventional image displaying apparatus, the light modulating element does not have ideal modulation characteristics; therefore, particularly when black is displayed, reduction in contrast caused by leakage of light from the light modulating element has occurred. Furthermore, since the light source is emitting light even when black is displayed, it has been difficult to reduce power consumption.

In order to suppress the reduction in contrast, a conventional technique in which luminance modulation of the light source and conversion of the gray levels of pixels of an input image (in other words, gamma conversion) are carried out in combination in accordance with the input image has been proposed. In all of the above described conventional techniques, the contrast can be increased by controlling the light-source luminance and the gray level conversion for the input image in accordance with the input image compared with an image displaying apparatus using constant light-source luminance. Moreover, since backlight luminance can be reduced in accordance with the input image, power consumption can be reduced.

However, when bright images are continuously displayed, the light source continues emitting light at high brightness. As a result, deterioration of the light source is advanced, the temperature of the light source is increased, and a problem that the life of the light source is shortened is caused.

In a plasma display panel (PDP) or an organic electro luminescence display (OLED), which is a light-emitting display apparatus having the problems similar to those described above, for example, still-image detection of input images is carried out; and, if a still image is continuously displayed for a predetermined period or longer, a process that, for example, reduces the contrast of the displayed image is carried out to prevent deterioration of a fluorescent body, which displays the image, (JP-A 2008-70683 (Kokai) and JP-A 2007-228474 (Kokai)).

The deterioration of the light source becomes a problem when a strong light emitting state continues for a long period of time. Therefore, in the conventional method in which the still images are detected, the luminance of the light source is reduced when a still image is continued for a certain period regardless of the light emitting state of the light source. Therefore, the luminance of the light source is excessively reduced, and image quality deterioration such as reduction in the screen luminance occurs.

DETAILED DESCRIPTION

Figure 1:
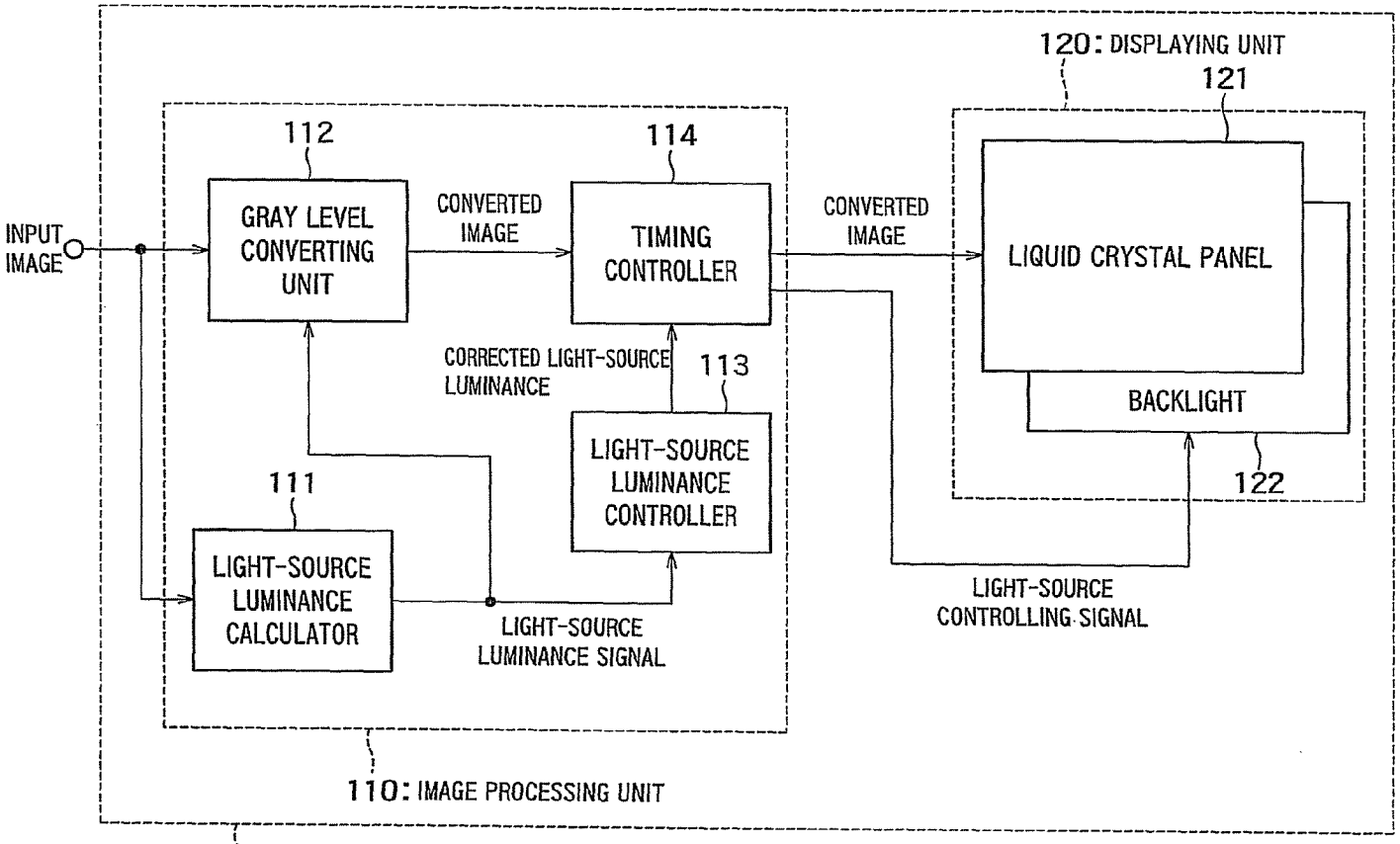
FIG. 1 is a drawing showing the configuration of an image displaying apparatus of a first embodiment.

According to an embodiment, there is provided with an image displaying apparatus having a backlight configured to emit light and a liquid crystal panel configured to display an image in a display region by modulating light from the backlight, including: a light-source luminance calculator, a gray level converting unit, a cumulative light-emission amount calculator, a comparing unit, a light-source luminance correcting unit and a controller.

The light-source luminance calculator calculates light-source luminance of the light emitted by the backlight based on pixel values of an input image.

The gray level converting unit converts gray levels of the input image based on the light-source luminance to a converted image.

The cumulative light-emission amount calculator calculates a cumulative light-emission amount by summing up light-source luminance for an arbitrary period for which an image is displayed at a time before the input image is displayed.

The comparing unit compares the cumulative light-emission amount with a reference light-emission amount determined in advance.

The light-source luminance correcting unit corrects the light source luminance to a smaller value when the difference between the cumulative light-emission amount and the reference light-emission amount is smaller than a reference to obtain corrected light-source luminance.

The controller carries out control to write the converted image to the liquid crystal panel and cause the backlight to emit light based on the corrected light-source luminance.

According to an embodiment, there is provided with an image processing apparatus for providing an image to an image displaying apparatus having a backlight to emit light and a liquid crystal panel to display the image in a display region by modulating light from the backlight, including: a light-source luminance, calculator, a gray level converting unit, a cumulative, light-emission amount calculator, a comparing unit, a light-source luminance correcting unit and a controller.

The light-source luminance calculator calculates light-source luminance of the light emitted by the backlight based on pixel values of an input image.

The gray level converting unit converts gray levels of the input image based on the light-source luminance to a converted image.

The cumulative light-emission amount calculator calculates a cumulative light-emission amount by summing up light-source luminance for an arbitrary period for which an image is displayed at a time before the input image is displayed.

The comparing unit compares the cumulative light-emission amount with a reference light-emission amount determined in advance.

The light-source luminance correcting unit corrects the light source luminance to become smaller when the difference between the cumulative light-emission amount and the reference light-emission amount is smaller than a reference to obtain corrected light-source luminance.

The controller provides the converted image to the liquid crystal panel and to provide the corrected light-source luminance to the backlight.

Embodiments of the present invention will be explained with reference to drawings. Configurations or processes that carry out mutually similar operations are denoted by common symbols, and redundant explanations will be omitted.

First Embodiment

In the present embodiment, an image displaying apparatus 100, which carries out liquid display, will be explained as an example.

FIG. 1 is a drawing showing the configuration of the image displaying apparatus 100 of the present embodiment. The image displaying apparatus 100 of the present embodiment has an image processing unit 110 and a displaying unit 120. The image processing unit 110 controls the displaying unit 120. The image processing unit 110 has a light-source luminance calculator 111, a gray level converting unit 112, a light-source luminance controller 113, and a timing controller 114. The displaying unit 120 has a backlight 122 and a liquid crystal panel 121, which is disposed on the front surface of the backlight 122 and displays video images in a display region by modulating the light emitted from the backlight 122.

An input image is input to the light-source luminance calculator 111 and the gray level converting unit 112. The light-source luminance calculator 111 calculates a light-source luminance signal, which indicates the light-emission luminance of the backlight 122, based on the input image. The light-source luminance signal is transmitted to the light-source luminance controller 113 and the gray level converting unit 112. The gray level converting unit 112 converts the gray levels of the pixels of the input image based on the light-source luminance signal to obtain a converted image. The light-source luminance controller 113 obtains corrected light-source luminance, which is corrected so that deterioration and temperature increase of the light source do not cause problems. The timing controller 114 transmits the converted image to the liquid crystal panel 121 and outputs a light-source controlling signal to the backlight 122 while synchronizing the output timing of the signals to the liquid crystal panel 121 and the backlight 122. Thus, the timing controller 114 carries out control so as to write the converted image to the liquid crystal panel 121 and carries out control so as to cause the backlight 122 to emit light based on the corrected light-source luminance. In the displaying unit 120, the converted image is written to the liquid crystal panel 121, and the backlight 122 emits light based on the light-source controlling signal. The image displaying apparatus 100 displays the image through the above processes.

Next, details of the operation of each of the units will be explained.

Figure 2:
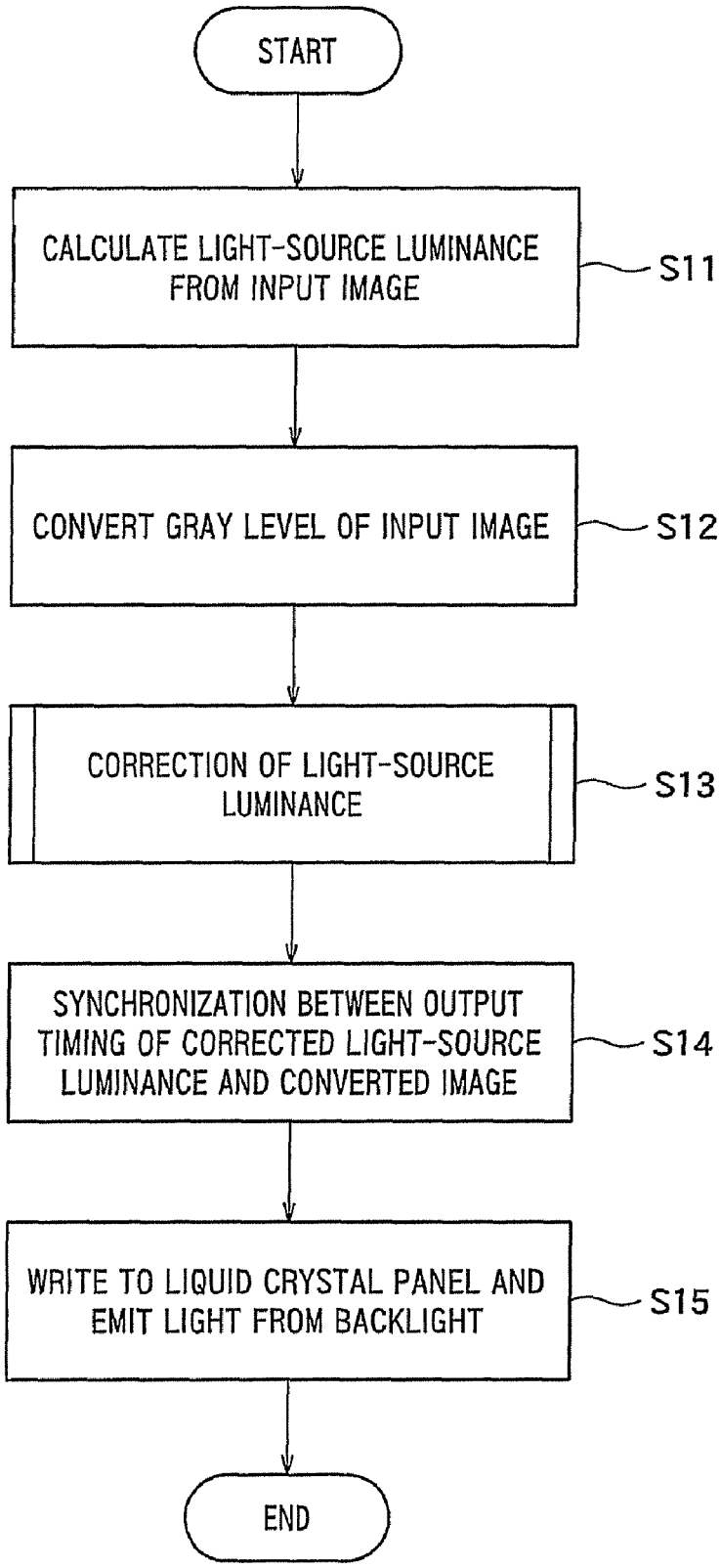
FIG. 2 is a drawing showing the operation of the image displaying apparatus of the first embodiment.

FIG. 2 is a drawing explaining the operation of the image displaying apparatus 100 of the present embodiment.

The light-source luminance calculator 111 obtains the light-source luminance, which is set for the backlight 122, from an input image (S11). The method of obtaining the light-source luminance may be any of various methods. The present embodiment shows as an example a configuration in which a maximum value is detected among the gray level values of the input image, and light-source luminance is calculated based on the maximum value. First, a maximum gray level is detected from the input image of one frame. Then, a maximum luminance value is calculated from the detected maximum gray level. For example, in the case of an image in which the input image is expressed by 8 bits (gray level 0 to gray level 255), the maximum luminance $I_{max}$ can be analytically obtained from the maximum gray level $L_{max}$ by Expression 1.

$$l_{max} = \left(\frac{L_{max}}{255}\right)^{\gamma} \quad \text{[Expression 1]}$$

In the expression, "γ" represents a gamma value of the liquid crystal panel 121, and "2.2" is generally set as the value. The maximum luminance in that case becomes a relative value of 0 to 1. For example, if the maximum gray level is the gray level of 202, the maximum luminance becomes about 0.6. In other words, the luminance higher than 0.6 is not required to be displayed by the displaying unit 120. Therefore, the backlight luminance is set to 0.6. The present embodiment is configured to calculate the backlight luminance by using Expression 1. However, for example, the embodiment may be configured to retain a look-up table, which is generated by obtaining the relation between the maximum gray level and the backlight luminance in advance, by a ROM (Read Only Memory) or the like. In that case, after the maximum gray level is detected from the input image, the backlight luminance is obtained by referencing the look-up table in accordance with the detected maximum gray level. The light-source luminance signal, which is obtained by the above process and represents the backlight luminance, is transmitted from the light-source luminance calculator 111 to the gray level converting unit 112 and the light-source luminance controller 113.

The gray level converting unit 112 carries out gray level conversion with respect to the input image based on the light-source luminance signal and outputs a converted image (S12). The gray level converting method may be any of various methods. In the present embodiment, an example in which a gain is imparted to the input image which is written to the liquid crystal panel 121, so as to compensate for reduction in the screen luminance based on reduction in the backlight luminance. The gain G imparted to the input image is obtained by Expression 2.

$$G = \frac{1}{l_{max}} \quad \text{[Expression 2]}$$

When the backlight luminance is set to 0.6, the gain is about 1.7. Then, based on the obtained gain, gray level conversion is carried out by Expression 3.

$$L_{out}(x,y)=G^{1/\gamma}\cdot L_{in}(x,y) \quad \text{[Expression 3]}$$

In the expression, "$L_{in}(x,y)$" represents the gray level of the pixel at a horizontal position "x" and a vertical position "y" of the input image, and "$L_{out}(x,y)$" represents the gray level of the pixel at the horizontal position "x" and the vertical position "y" of the converted image. The present embodiment is configured to carry out the gray level conversion by using Expression 2 and Expression 3. However, for example, the embodiment may be configured to retain a look-up table, which is generated by obtaining in advance the relation between the light-source luminance and the gain ("$G^{1/\gamma}$" of Expression 3") by which the input image is multiplied, in a ROM (Read Only Memory) or the like. In that case, the gain by which the input video signal is to be multiplied is obtained by referencing the look-up table with the value of the light-source luminance, and the calculation of Expression 3 is carried out.

The converted image obtained through the above processes is transmitted from the gray level converting unit 112 to the timing controller 114.

The light-source luminance controller 113 predicts the deterioration and temperature increase of the light source from the light-source luminance signal calculated by the light-source luminance calculator 111 and obtains corrected light-source luminance, which has corrected the light-source luminance, so as to prevent causing a problem of the deterioration and temperature increase (S13). Details of the process carried out in S13 will be described later.

The timing controller 114 controls the timing to write the converted image to the liquid crystal panel 121 and the timing to apply the corrected light-source luminance to the backlight 122 (S14). The timing controller 114 generates some synchronizing signals (horizontal synchronizing signal, vertical synchronizing signal, etc.) required for driving the liquid crystal panel 121. The converted image is transmitted to the liquid crystal panel 121 together with the some synchronizing signals (horizontal synchronizing signal, vertical synchronizing signal, etc.), which have been generated by the timing controller 114 and are required for driving the liquid crystal panel 121. Furthermore, the timing controller 114 generates a light-source controlling signal for lighting the light source of the backlight 122 at the corrected light-source luminance at the same time as the output of the converted image to the liquid crystal panel 121 and transmits the light-source controlling signal to the backlight 122. The configuration of the light-source controlling signal is different depending on the type of the light source installed in the backlight 122. Generally, a cold cathode tube, a light-emitting diode (LED), or the like is used as the light source of the backlight 122 of the liquid crystal displaying apparatus. The luminance thereof can be modulated by controlling the voltage or current applied thereto. Generally, PWM (Pulse Width Modulation) control in which luminance is modulated by switching the periods of light emission and no light emission at high speed is used. The present embodiment is configured to use an LED light source, for which light-emission intensity is comparatively easily controlled, as the light source of the backlight 122 and subject the LED light source to luminance modulation by PWM control. Therefore, the light-source controlling signal, which carries out luminance modulation by PWM control based on the corrected light-source luminance, is transmitted from the timing controller 114 to the backlight 122.

In the displaying unit 120, the converted image transmitted from the timing controller 114 is written to the liquid crystal panel 121 (light modulating element), and the backlight 122 is lit based on the light-source controlling signal also transmitted from the timing controller 114 (S15). As described above, in the present embodiment, the LED light source is used as the light source of the backlight 122.

Next, the method by which the light-source luminance controller 113 calculates the corrected light-source luminance will be described in detail.

Figure 3:
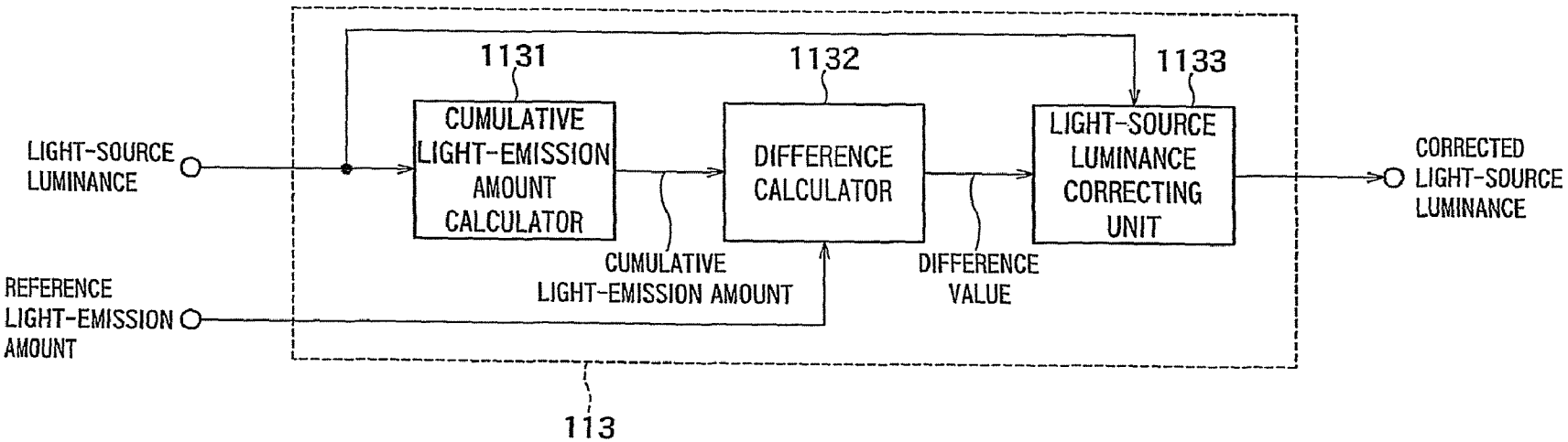
FIG. 3 is a drawing showing the configuration of a light-source luminance controller of the first embodiment.

FIG. 3 is a drawing showing the configuration of the light-source luminance controller 113 in the present embodiment. The light-source luminance controller 113 is provided with a cumulative light-emission amount calculator 1131, a difference calculator 1132, and a light-source luminance correcting unit 1133. The cumulative light-emission amount calculator 1131 calculates the cumulative light-emission amount of the light-source luminance in a predetermined period and transmits the cumulative light-emission amount, to the difference calculator 1132. The difference calculator 1132 compares the cumulative light-emission amount with a reference light-emission amount, which is determined in advance. Specifically, the difference calculator 1132 calculates the value of the difference between the cumulative light-emission amount and the reference light-emission amount and transmits the difference value to the light-source luminance correcting unit 1133. The light-source luminance correcting unit 1133 obtains the corrected light-source luminance, which has corrected the light-source luminance, based on the difference value and transmits the corrected light-source luminance to the timing controller 114.

Next, details of the operation of each of the units of the light-source luminance controller 113 will be explained.

Figure 4:
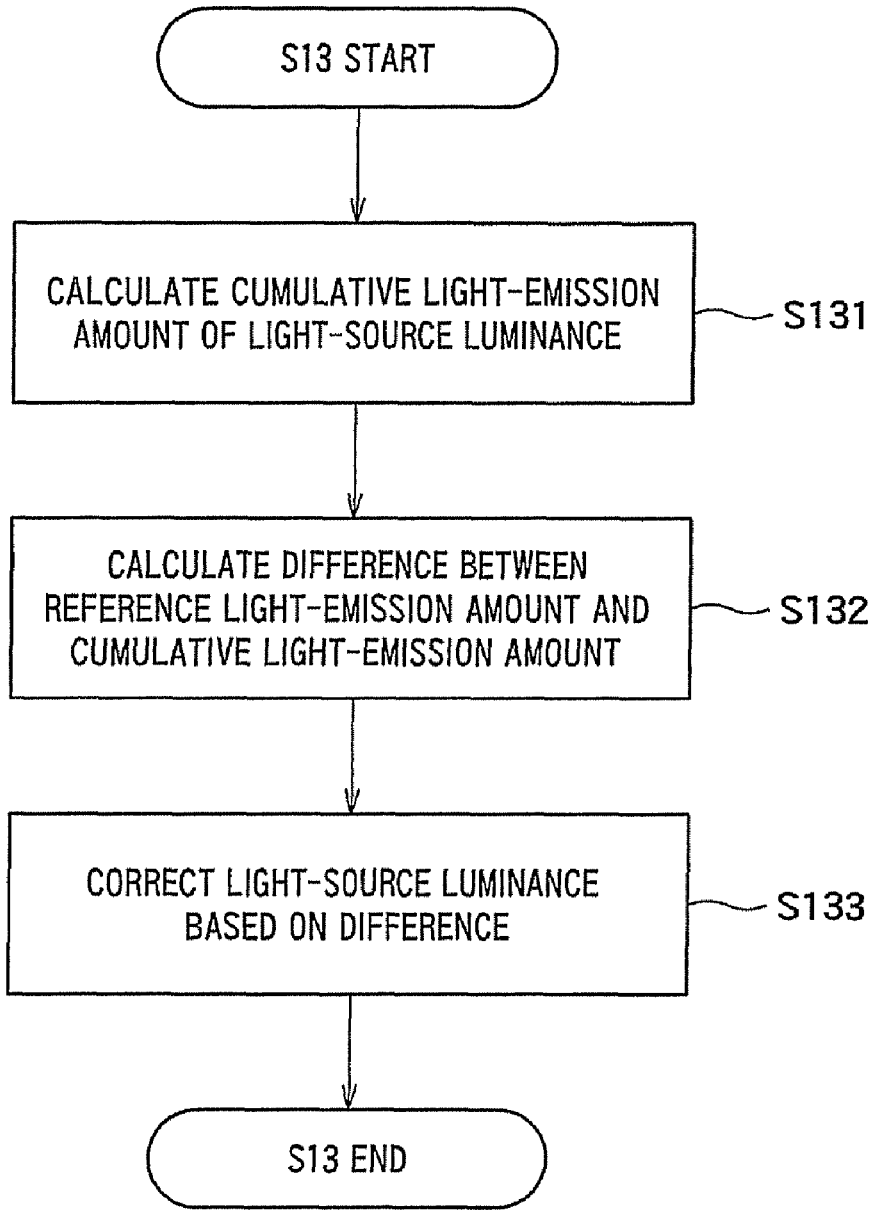
FIG. 4 is a drawing showing the operation of the light-source luminance controller of the first embodiment.

FIG. 4 is a drawing showing details of the operation (S13) in which the light-source luminance controller 113 calculates the corrected light-source luminance.

The cumulative light-emission amount calculator 1131 calculates the cumulative light-emission amount of the light-source luminance (S131). As a method of calculating the cumulative light-emission amount, there is a method in which the light-source luminance is subjected to a moving average filter, wherein the light-source luminance per unit time is subjected to addition. However, in the case in which the moving average filter is used, the luminance corresponding to the unit time has to be retained, and the volume of a memory is increased. Therefore, the present embodiment is configured to obtain the cumulative light-emission amount by an infinite impulse response (IIR) filter. The cumulative light-emission amount by the IIR filter is obtained by Expression 4.

$$F(t)=\alpha\cdot I(t)+(1-\alpha)\cdot F(t-1) \quad \text{[Expression 4]}$$

In the expression, "I(t)" represents the light-source luminance at time "t" calculated by the light-source luminance calculator 111, and "F(t)" represents the cumulative light-emission amount at time "t", and "α" represents a coefficient that determines the characteristics of the IIR filter. A large "α" corresponds to the case in which the unit time for obtaining the moving average is short. The cumulative light-emission amount obtained by Expression 4 is transmitted to the difference calculator 1132.

The difference calculator 1132 obtains the difference between the reference light-emission amount, which has been set in advance, and the cumulative light-emission amount, which has been calculated by the cumulative light-emission amount calculator 1131 (S132). The value of the difference is obtained by Expression 5.

$$\Delta I(t)=I_b-F(t) \quad \text{[Expression 5]}$$

In the expression, "ΔI(t)" represents the difference value at the time "t", and "$I_b$" represents the reference light-emission amount. As the reference light-emission amount, the light-source luminance that does not cause a problem of deterioration or temperature even when the light source emits light for a long period of time at the light-source luminance of the reference light-emission amount is set. The calculated difference value is transmitted to the light-source luminance correcting unit 1133.

The light-source luminance correcting unit 1133 obtains the corrected light-source luminance, which has corrected the light-source luminance, based on the difference value calculated by the difference calculator 1132 (S133). Various methods are conceivable as the method of correcting the light-source luminance. However, the present embodiment is configured to obtain the corrected light-source luminance by obtaining a light-source luminance correction coefficient whose value is reduced as the difference value is reduced and multiplying the light-source luminance by the light-source luminance correction coefficient. The flow of a specific process will be explained below.

First, based on the difference value, the light-source luminance correction coefficient is calculated by Expression 6.

$$G_c = \min\left(1,\ \frac{1-G_{min}}{\Delta I_{th}}\cdot\Delta I(t)+G_{min}\right) \quad \text{[Expression 6]}$$

In the expression, "$G_C$" represents the light-source luminance correction coefficient, "$G_{min}$" represents the minimum value of the light-source luminance correction coefficient, "$\Delta I_{th}$" represents a threshold value from which correction of the light-source luminance is started, and "min(x,y)" is a function that returns small values of "x,y". The relation of Expression 6 is shown in FIG. 5.

Figure 5:
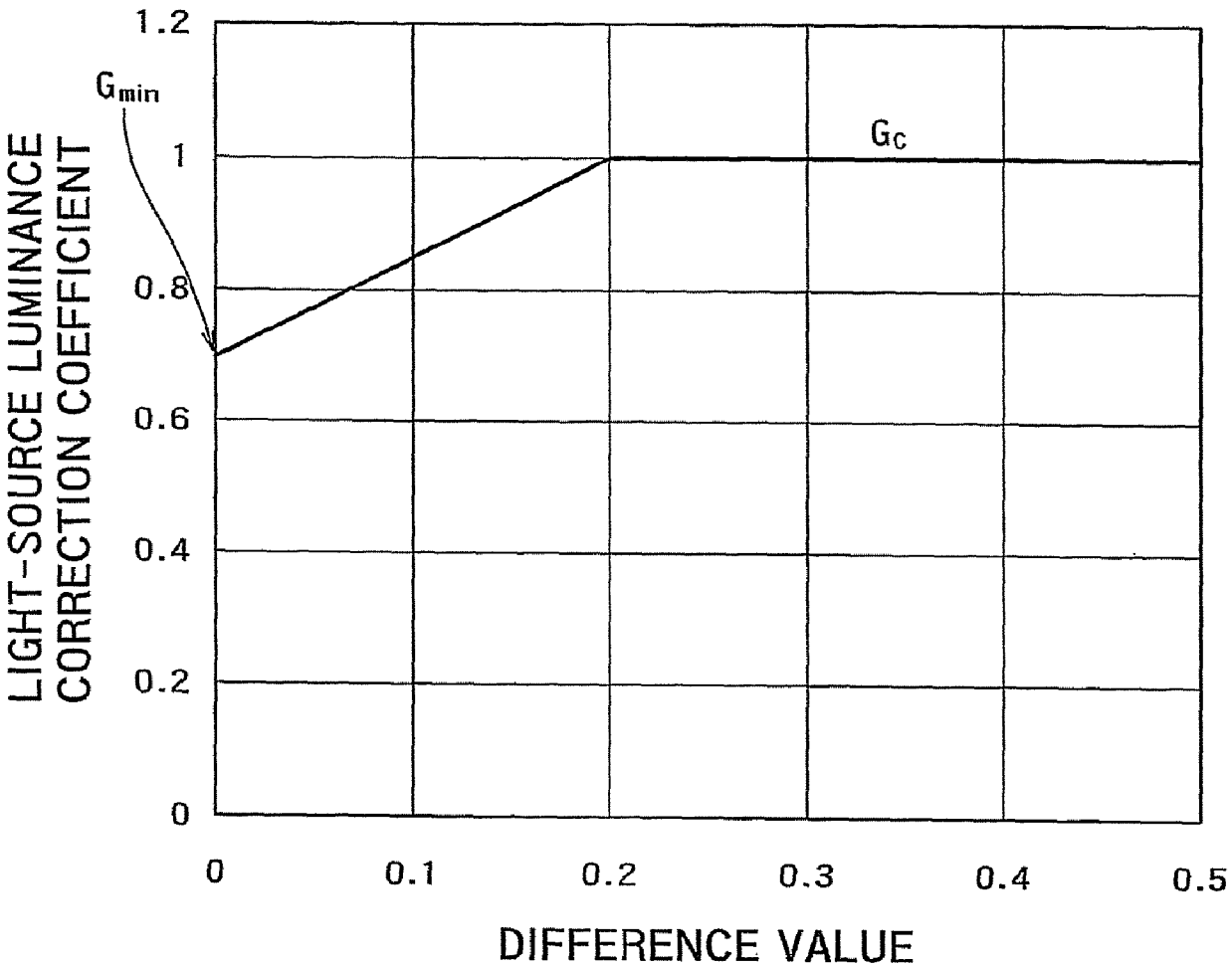
FIG. 5 is a drawing showing the relation between a difference value and a light-source luminance correction coefficient.

FIG. 5 is a drawing showing the relation between the difference value and the light-source luminance correction coefficient. The horizontal axis represents the difference value "ΔI(t)", and the vertical axis represents the light-source luminance correction coefficient "$G_c$". If the difference value is large, the light-source luminance correction coefficient is 1.0; if the difference value is equal to or lower than the threshold value "$\Delta I_{th}$", the light-source luminance correction coefficient has a value of less than 1.0; and, if the difference value is 0, the light-source luminance correction coefficient is "$G_{min}$". "$G_{min}$" is set so that the corrected light-source luminance is equal to or lower than the light-source luminance of the reference light-emission amount even when the light-source luminance has a maximum value. In other words, "$G_{min}$" is set so that, at any light-source luminance, deterioration or temperature does not become a problem even when the light source emits light for a long period of time at the corrected light-source luminance obtained when the light-source luminance correction coefficient is "$G_{min}$". In this case, the configuration in which the light-source luminance correction coefficient is obtained by Expression 6 is employed; however, a below configuration can be also employed as another configuration. The relation between "ΔI(t)" and "$G_c$" is obtained in advance by Expression 6 and retained in a ROM (Read Only Memory) or the like as a look-up table (LUT). Then, LUT may be referenced according to the difference value to obtain the corresponding light-source luminance correction coefficient.

The light-source luminance is corrected by Expression 7 by using the light-source luminance correction coefficient obtained by Expression 6.

$$I'(t)=G_c\cdot I(t) \quad \text{[Expression 7]}$$

In the expression, "I'(t)" represents the corrected light-source luminance.

Figure 6:
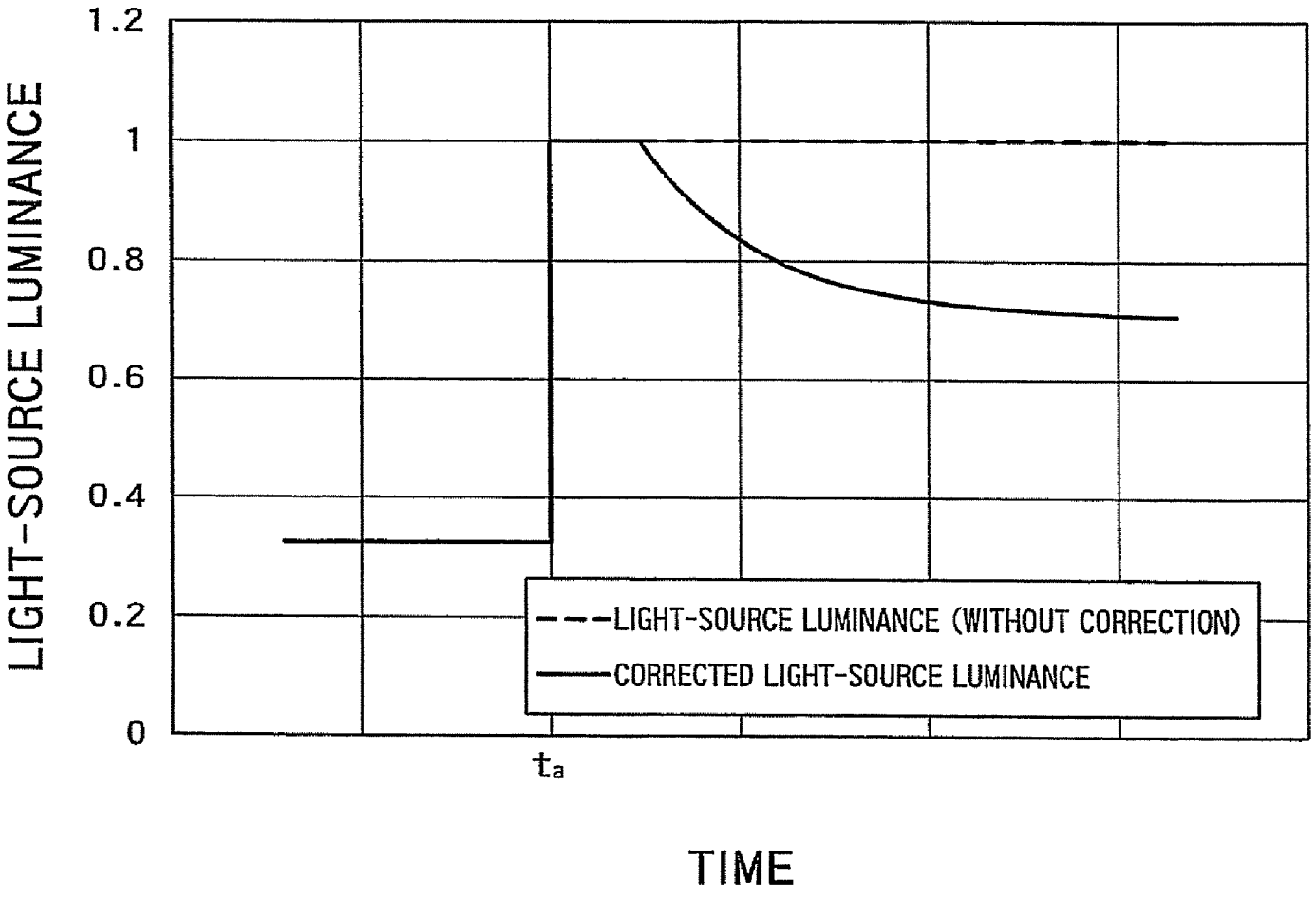
FIG. 6 is a drawing showing the light-source luminance calculated by a light-source luminance calculator and the time change of corrected light-source luminance.
Figure 7:
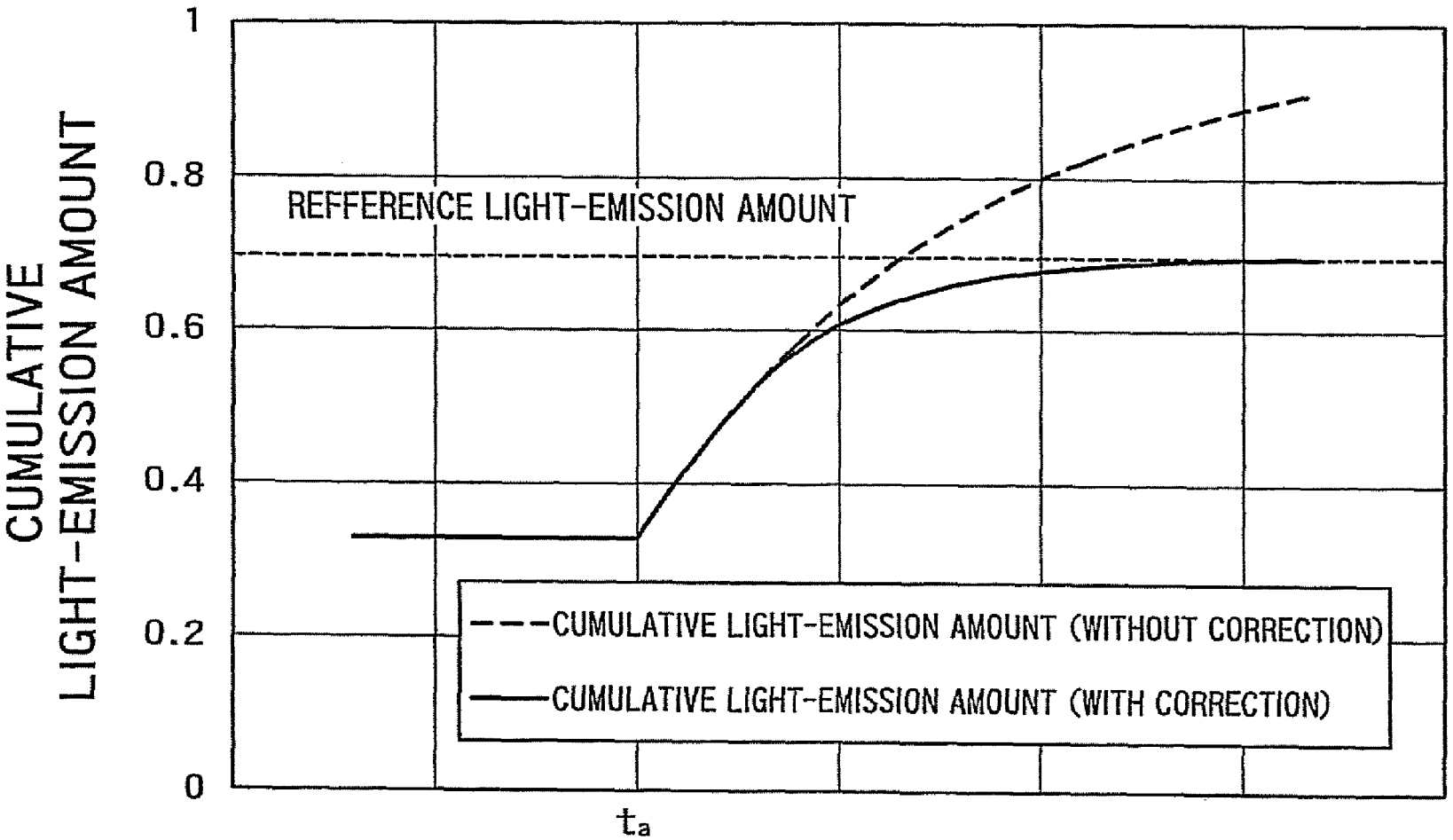
FIG. 7 is a drawing showing an example of a cumulative light-emission amount of the case in which light-source luminance is corrected when a reference light-emission amount is set to 0.7.

Temporal changes of the light-source luminance, the corrected light-source luminance, and the cumulative light-emission amount in the light-source luminance controller 113 will be explained below. FIG. 6 shows the time changes of the light-source luminance calculated by the light-source luminance calculator 111 and the corrected light-source luminance. FIG. 6 shows the case in which the light-source luminance is changed from 0.33 to 1.0 at time "$t_a$" (broken line in FIG. 6). FIG. 7 shows the time change of the cumulative light-emission amount in the case in which the time change of the light-source luminance is that of FIG. 6. When the correction of the light-source luminance is not carried out, the cumulative light-emission amount is gradually increased from time "$t_a$" and approaches the light-source luminance of 1.0 as shown by the broken line of FIG. 7. When the correction of the light-source luminance as described above is carried out while the reference light-emission amount is set to 0.7 as shown in FIG. 7, first, the difference value of the reference light-emission amount and the cumulative light-emission amount becomes smaller than the threshold value "$\Delta I_{th}$", the light-source luminance correction coefficient becomes a small value as shown in FIG. 5, and, as a result, the corrected light-source luminance is corrected to the values smaller than 1.0 as shown by the solid line of FIG. 6. Therefore, the increase in the cumulative light-emission amount is reduced as shown in the solid line of FIG. 7 and is converged to the reference light-emission amount. In other words, the light-source luminance is corrected to the luminance at which deterioration or temperature does not cause a problem.

The corrected light-source luminance obtained in the above described manner is transmitted to the timing controller 114, and the process of S13 is finished.

According to the present embodiment, an image processing apparatus and an image displaying apparatus equipped with the image processing apparatus which realize high-dynamic-range display like that of CRT by a small circuit scale while suppressing increase in power consumption as much as possible can be provided. According to the present embodiment, an image processing device and an image displaying apparatus equipped with the image processing device which suppress deterioration and temperature increase of the light source as much as possible if light emission is continued for a long period of time in a high light-source luminance state can be provided.

Second Embodiment

Figure 8:
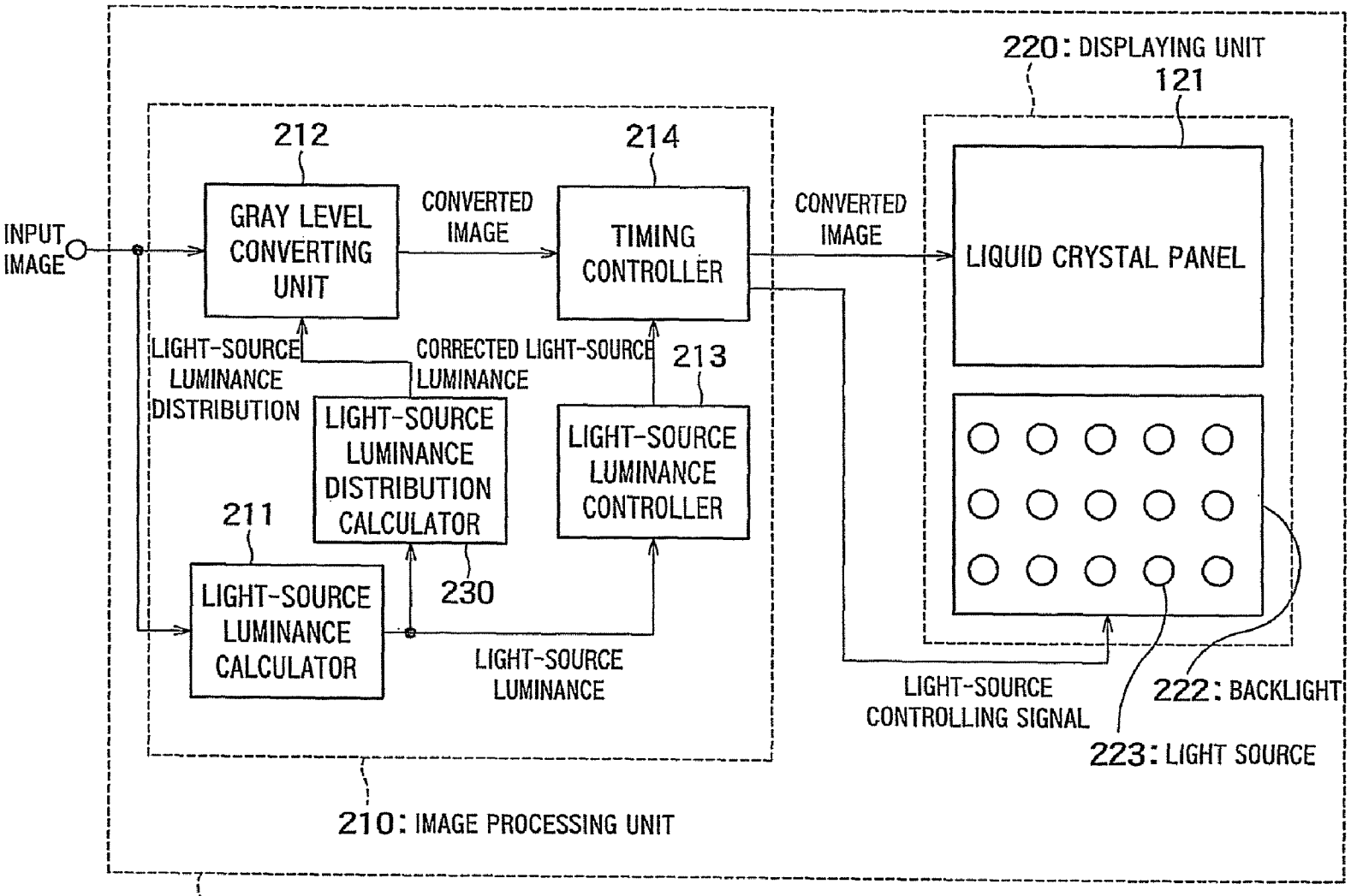
FIG. 8 is a drawing showing the configuration of an image displaying apparatus of a second embodiment.

FIG. 8 is a drawing showing the configuration of an image displaying apparatus 200 of the present embodiment. The image displaying apparatus 200 has an image processing unit 210 and a displaying unit 220. The image processing unit 210 controls the displaying unit 220.

The image processing unit 210 has a light-source luminance calculator 211, a gray level converting unit 212, a light-source luminance distribution calculator 230, a light-source luminance controller 213, and a timing controller 214. The displaying unit 220 has a backlight 222 and a liquid crystal panel 121, which is disposed at a front surface of the backlight 222 and modulates the light emitted by the backlight 222. The backlight 222 is provided with a plurality of light sources 223, which can control respective light-emission luminance.

The light-source luminance calculator 111 calculates the light-source luminance for each of the light sources 223 based on the pixel values of the input image in the illumination regions, which is obtained by tentatively dividing the displaying region of the liquid crystal panel 121 based on the spatial arrangement of the light sources 223. The light-source luminance is transmitted to the light-source luminance distribution calculator 230 and the light-source luminance controller 213. Based on the shape of the light-emission luminance distribution of the case in which one of the light sources 223 of the backlight 222 independently emits light, the light-source luminance distribution calculator 230 calculates the distribution of the backlight luminance of the case in which the plurality of light sources emit light at the light-source luminance calculated by the light-source luminance calculator 111. The calculated light-source luminance distribution is input to the gray level converting unit 212. The gray level converting unit 212 carries out conversion of the gray levels of the pixels of the input image based on the light-source luminance distribution to obtain a converted image. The light-source luminance controller 213 corrects each of the light-source luminance so that deterioration and temperature increase of the light sources 223 do not cause problems and obtains corrected light-source luminance. The timing controller 214 transmits a converted image to the liquid crystal panel 121 while synchronizing the output timing of the signals to the liquid crystal panel 121 and the backlight 222 and outputs a light-source controlling signal to the backlight 222. The displaying unit 220 writes the converted image to the liquid crystal panel 121 and causes the backlight 222 to emit light based on the light-source controlling signal, thereby displaying the image.

The operations of each of the units will be explained below.

Figure 9:
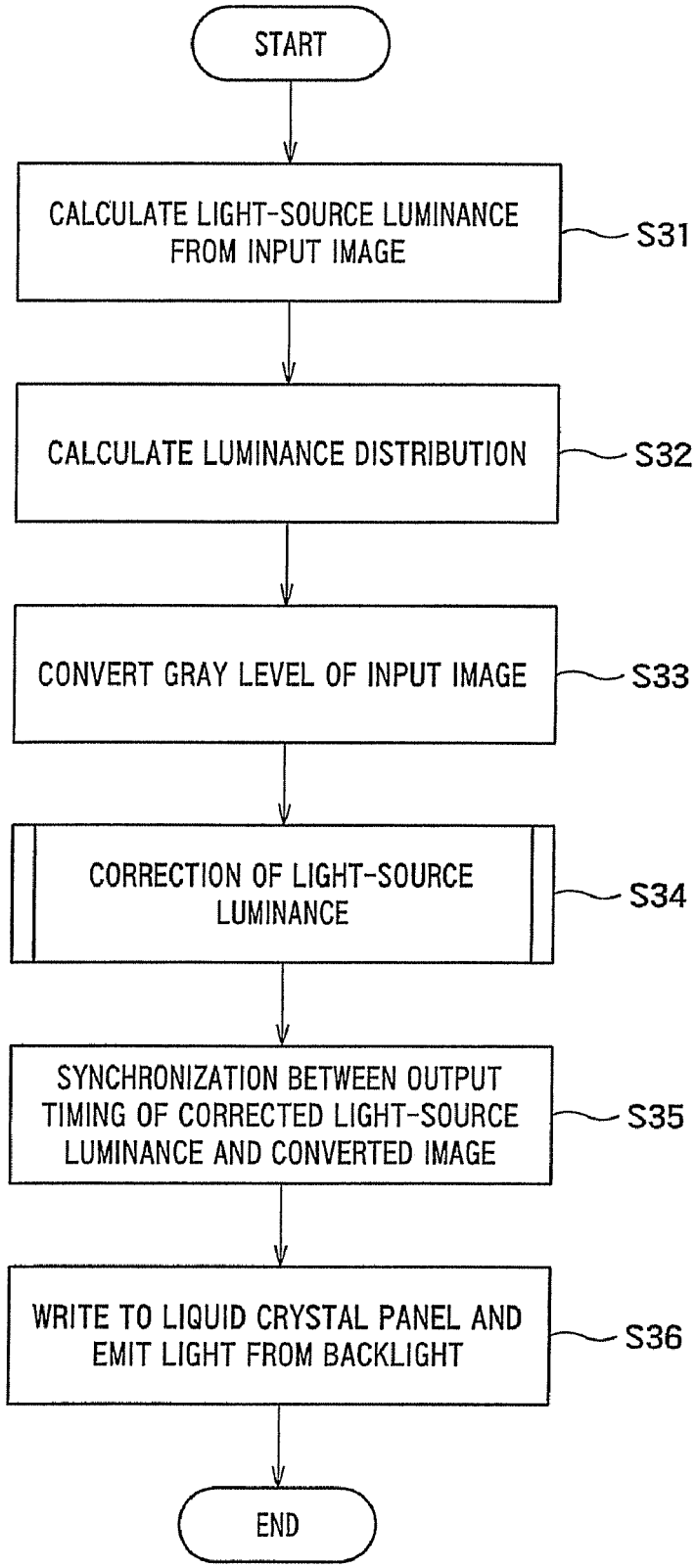
FIG. 9 is a drawing showing the operation of the image displaying apparatus of the second embodiment.

FIG. 9 is a drawing explaining the operation of the image displaying apparatus 200 of the present embodiment.

Figure 10:
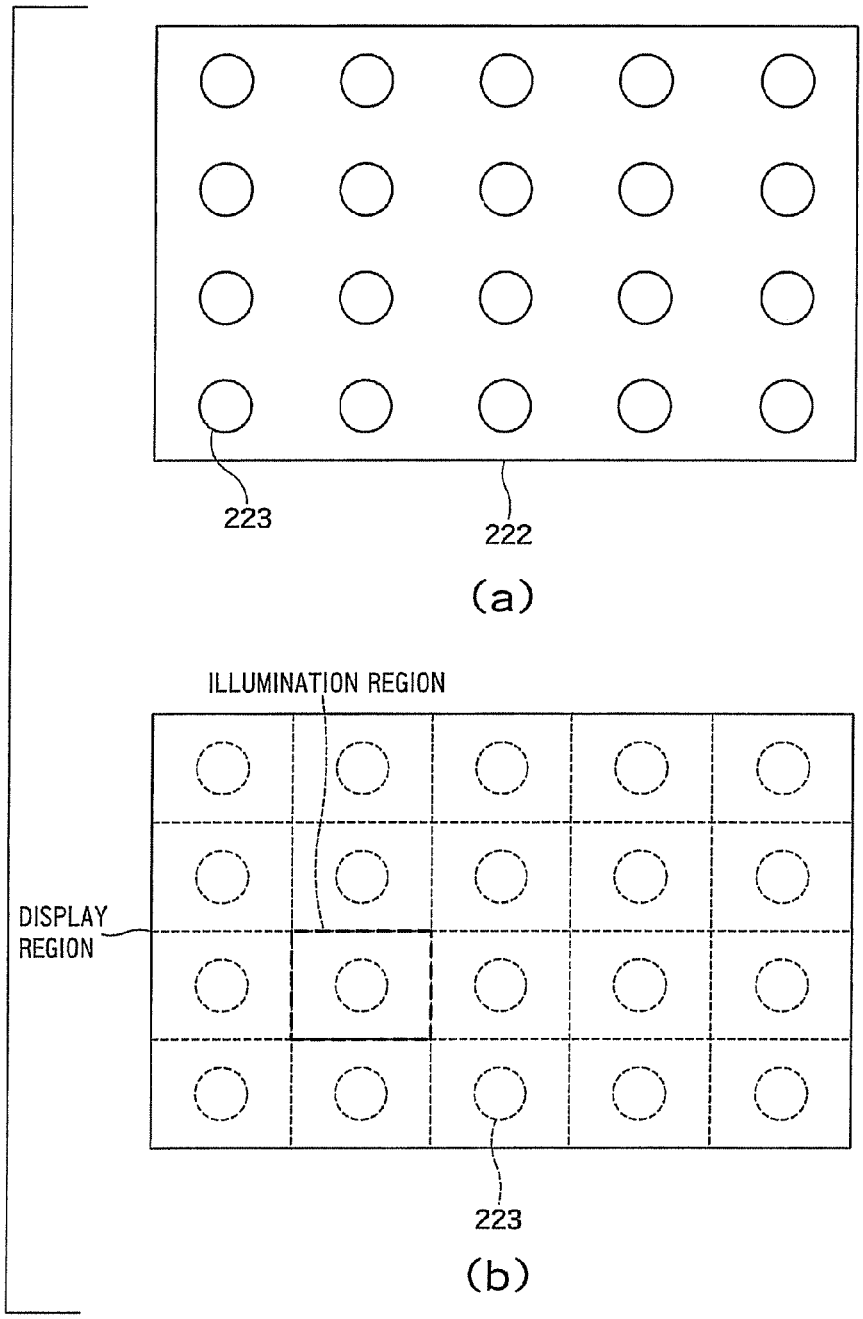
FIG. 10 (*a*) is a drawing showing an arrangement example of light sources, and FIG. 10 (*b*) is a drawing explaining a method of setting illumination regions in the case of the arrangement example of FIG. 10 (*a*).

The light-source luminance calculator 211 calculates the light-source luminance of each of the plurality of light sources of the backlight (S31). In the present embodiment, the light-source luminance is calculated for each of the light sources 223 based on the pixel values of the input image in the illumination regions, which is obtained by tentatively dividing the display region of the liquid crystal panel 121 based on the spatial arrangement of the light sources 223. FIG. 10 (*a*) is a drawing showing an example of the arrangement of the light sources 223. FIG. 10 (*a*) shows the example of the backlight 223 having the structure in which five light sources 223 are installed in the horizontal direction and four light sources are installed in the vertical direction. FIG. 10 (*b*) is a drawing showing an example of the method of setting the illumination regions in the case in which the backlight 223 has the arrangement of FIG. 10 (*a*). The maximum gray level of the input image is calculated for each of the illumination regions, which have been obtained by dividing the input image into the 5×4 regions so as to correspond to the light sources 223. Then, based on the maximum gray level calculated for each of the illumination region, the light-source luminance of each of the light sources corresponding to the respective illumination region is calculated. For example, in the case in which the input image is an image expressed 8 bits (gray level 0 to gray level 255), if the maximum value of the i-th illumination region is "$L_{max}$ (i)", the light-source luminance is calculated by Expression 8.

$$I(i) = \left(\frac{L_{max}(i)}{255}\right)^{\gamma} \quad \text{[Expression 8]}$$

In the expression, "γ" is a gamma value and generally uses 2.2, and "I(i)" is the i-th light-source luminance. The light-source luminance can be obtained by the calculation by Expression 8. However, the light-source luminance "I" may be configured to be obtained by obtaining the relation between "$L_{max}$" and "I" in advance, retaining the relation in a look-up table (LUT) composed of a ROM (Read Only Memory) or the like, and referencing LUT by the value of "$L_{max}$" after obtaining "$L_{max}$". The present embodiment is configured so that one light source corresponds to each illumination region. However, for example, the embodiment may be configured so that one illumination region corresponds to a plurality of light sources. Other than equally dividing the illumination regions of the input image by the number of the light sources as shown in FIG. 10, the configuration in which illumination regions are set for the input image so that part of the illumination regions are mutually overlapped to calculate the maximum gray levels of the illumination regions can be also employed. The calculated light-source luminance of each of the light sources is transmitted to the light-source luminance distribution calculator 230 and the light-source luminance controller 213.

The light-source luminance distribution calculator 230 calculates the actual luminance distribution of the backlight based on the light-source luminance of the light sources (S32).

Figure 11:
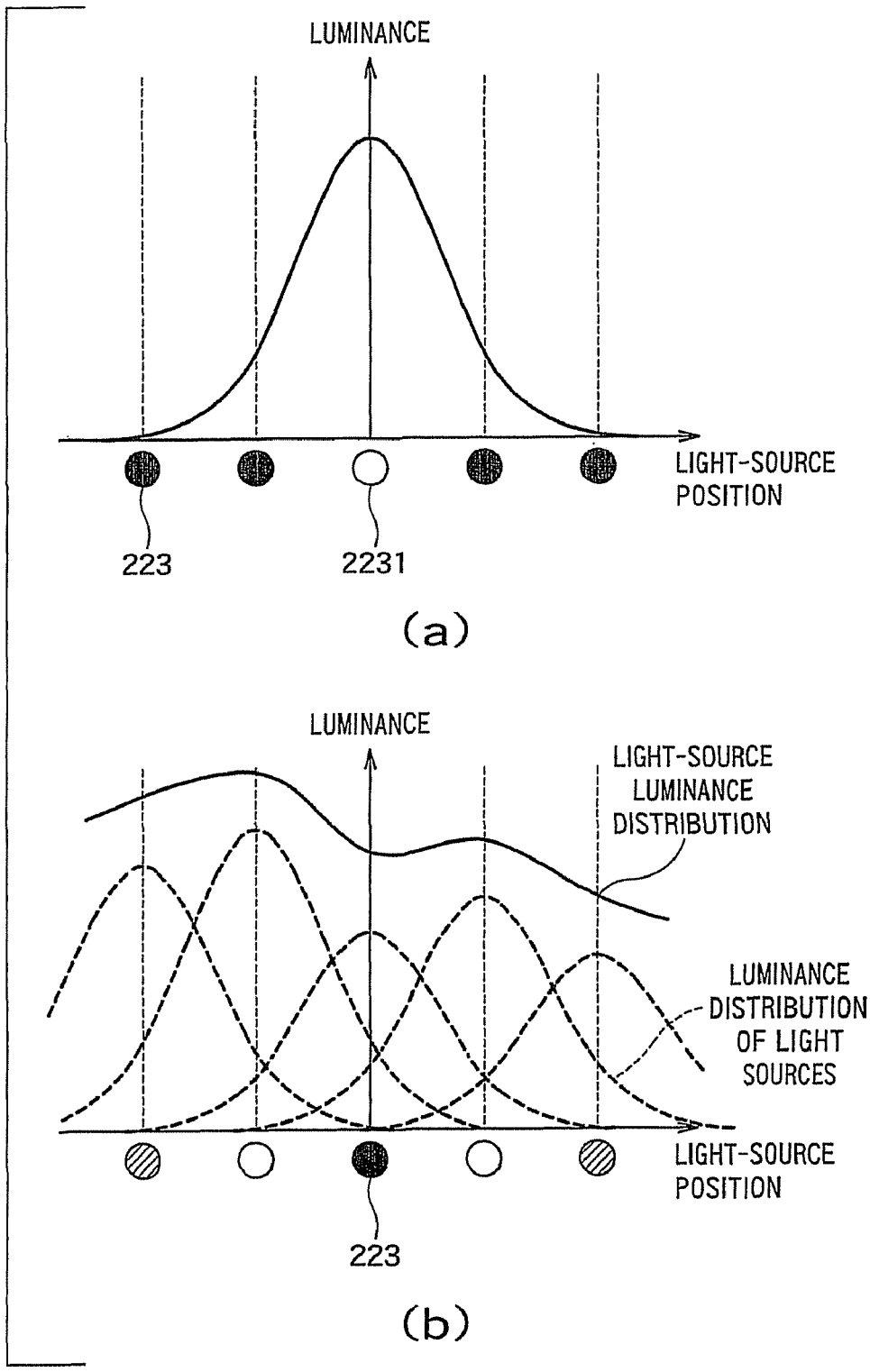
FIG. 11 is a drawing explaining luminance distribution.

FIG. 11 is a drawing explaining the luminance distribution. In order to simplify explanation, the luminance distribution is expressed one dimensionally, wherein the horizontal axis shows positions, and the vertical axis shows the luminance. FIG. 11 (*a*) shows the luminance distribution of the case in which one light source 2231 emits light among the plurality of light sources 223 of the backlight 222. The light sources 223 are installed at the positions shown in a lower part of FIG. 11 (*a*), and the luminance distribution of the case in which only the single light source 2231 at the center is lit is shown. As is understood from FIG. 11 (*a*), the luminance distribution of the case in which the light source 2231 emits light is expanded to the positions of the light sources in the vicinity thereof. Therefore, in order to carry out gray level conversion by the gray level converting unit 212 based on the backlight luminance, the light-emission luminance distribution shown in FIG. 11 (*a*) based on the light-source luminance of each of the plurality of light sources 223 of the backlight 222 has to be summed. FIG. 11 (*b*) schematically shows the state of the light-source (backlight) luminance distribution of the case in which the plurality of light sources 223 are lit. When the light sources at the positions shown in the lower part of FIG. 11 (*b*) are lit, the light sources 223 have the luminance distribution as shown by the broken lines in FIG. 11 (*b*). The luminance distribution of the light sources 223 shown by the broken lines is summed to calculate the light-source luminance distribution. The calculation result of the light-source luminance distribution is shown by the solid line of FIG. 11 (*b*). As the luminance distribution of the light source 2231 shown in FIG. 11 (*a*), an approximate function of an actually measured value related to the distance from the light source may be configured to be obtained and retained in the light-source luminance distribution calculator 230. In the present embodiment, as the luminance distribution of the light source as shown in FIG. 11 (*a*), the relation between the distance from the light source and the luminance is configured to be obtained and retained in a ROM as a LUT 232.

Figure 12:
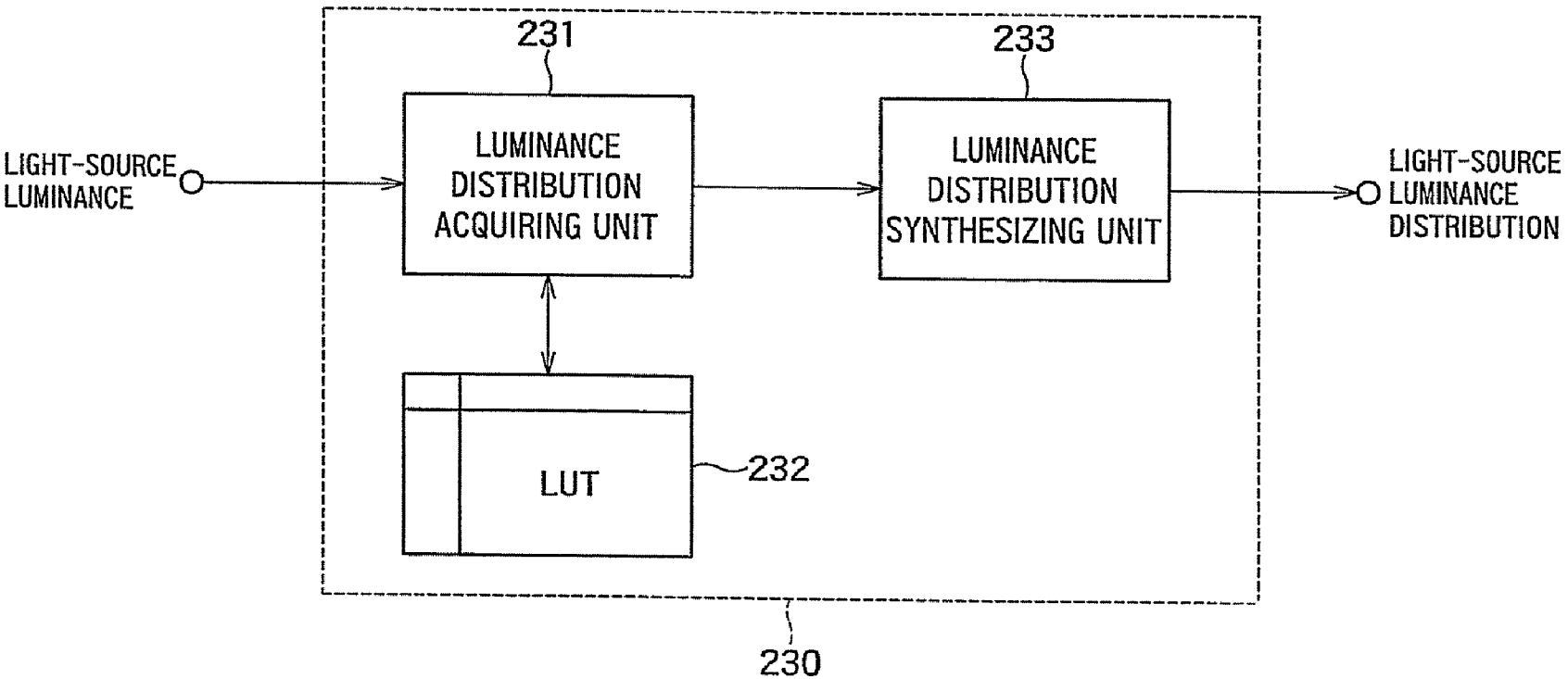
FIG. 12 is a drawing explaining the configuration of a light-source luminance distribution calculator of the second embodiment.

FIG. 12 shows the configuration of the light-source luminance distribution calculator 230 of the present embodiment. The light-source luminance calculated for each of the plurality of light sources 223 is input to a light-source luminance distribution acquiring unit 231. In the light-source luminance distribution acquiring unit 231, the luminance distribution of each of the light sources is acquired from the LUT 232 and multiplied by output light-source luminance, thereby obtaining the luminance distribution of each of the light sources 223 as shown by the broken line of FIG. 11 (*b*). Then, the luminance distribution of the light sources is summed in a luminance distribution synthesizing unit 233. Through the above configuration, the light-source luminance distribution as shown in the solid line of FIG. 11 (*b*), which has been obtained by summing the luminance distribution of the light sources, is transmitted to the gray level converting unit 212.

The gray level converting unit 212 converts the gray level values of the pixels of the input image based on the light-source luminance distribution (S33).

Since luminance of the light-source luminance calculated by the light-source luminance calculator 211 is reduced, the transmittance of the liquid crystal panel 121, in other words, gray level values have to be converted, in order to obtain desired brightness. When the gray level values of the sub pixels of red, green, and blue at the position (x, y) of the input image are "$L_R(x,y)$", "$L_G(x,y)$", and "$L_B(x,y)$", respectively, the gray level values of the sub pixels of red, green, and blue after gray level conversion are calculated in the below manner.

[Expressions 9]

$$L'_R(x, y) = \frac{L_R(x, y)}{I_d(x, y)1/\gamma}$$

$$L'_G(x, y) = \frac{L_G(x, y)}{I_d(x, y)1/\gamma}$$

$$L'_B(x, y) = \frac{L_B(x, y)}{I_d(x, y)1/\gamma}$$

In the expressions, "$I_d(x,y)$" is the luminance of the backlight at the position (x,y) of the input image calculated by the light-source luminance distribution calculator 230. The gray level values after gray level conversion may be obtained by calculations by Expressions 9. The present embodiment is configured to prepare a LUT retaining the relation of the gray level value "L", the light-source luminance distribution "$I_d$", and the converted gray level value "L'" and obtain the converted gray level value "L'(x,y)" by referencing the LUT according to the gray level value "L(x,y)" of the input image and the light-source luminance distribution "$I_d(x,y)$". Furthermore, in Expressions 9, sometimes the converted gray level value "L" exceeds 255, which is the maximum gray level value of the liquid crystal panel 121, depending on the gray level value "L" and the value of the light-source luminance distribution "$I_d$". In such a case, for example, the converted gray level value may be configured to be subjected to a saturating process with 255. However, ruined gray level is generated at the gray level value which has undergone the saturating process. Therefore, as another configuration example, the converted gray level value retained in the LUT can be corrected so that the value is gradually changed in the vicinity of the saturated gray level value.

In the light-source luminance calculator 211 and the light-source luminance distribution calculator 230, the light-source luminance distribution is calculated by using all of the gray level values of the input image of one frame. Therefore, at the timing when the input image is input to the gray level converting unit 212, the light-source luminance distribution corresponding to the input image has not been calculated. Therefore, the gray level converting unit 212 is provided with a frame memory. The input image is once retained in the frame memory, and, after a delay of one-frame period, the converted image is generated based on the light-source luminance distribution. However, since the input image is continuous by some degree in terms of time, for example, a converted image may be configured to be generated from the current input image based on the light-source luminance distribution obtained by the input image of the previous frame. In that case, the input image is not required to be delayed by one-frame period in the gray level converting unit 212. Therefore, the frame memory is not required to be installed, and the circuit scale can be reduced.

The light-source luminance controller 213 predicts the deterioration and temperature increase of the light sources from the light-source luminance signals of the light sources calculated by the light-source luminance calculator 211 and obtains and outputs corrected light-source luminance of the plurality of light sources so that the deterioration and temperature increase do not cause problems (S34). Details of the process carried out in S34 will be described later.

The timing controller 214 controls the timing to write the converted image to the liquid crystal panel 121 and the timing to apply the corrected light-source luminance of the plurality of light sources to the backlight (S35).

The input converted image is transmitted to the liquid crystal panel 121 together with some synchronizing signals (horizontal synchronizing signal, vertical synchronizing signal, etc.), which have been generated by the timing controller 214 and are required for driving the liquid crystal panel 121. At the same time, light-source controlling signals for lighting the light sources 223 of the backlight 222 at desired luminance based on the corrected light-source luminance are generated and transmitted to the backlight 222.

The displaying unit 220 writes the converted image, which has been transmitted from the timing controller 214, to the liquid crystal panel 121 (light modulating element) and lights the backlight 222 based on the light-source controlling signals also transmitted from the timing controller 214 (S36).

Next, the method of calculating the corrected light-source luminance by the light-source luminance controller 213 will be described in detail. A flow chart thereof will be omitted.

Figure 13:
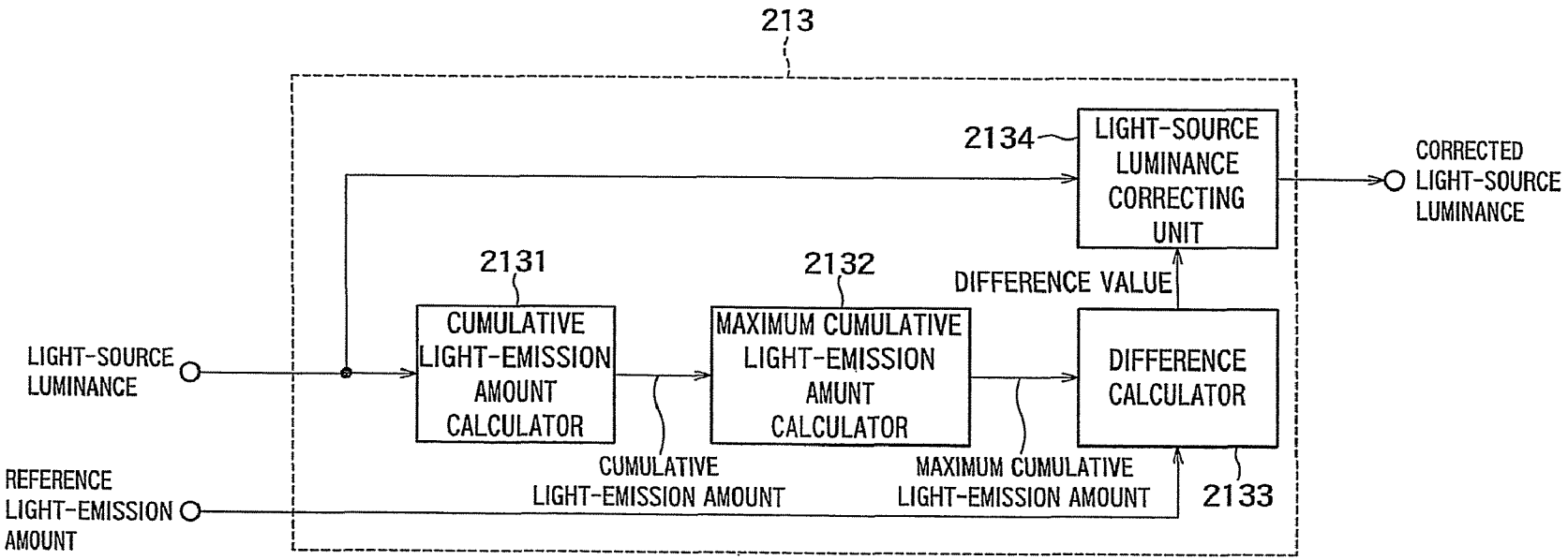
FIG. 13 is a drawing showing the configuration of a light-source luminance controller of the second embodiment.

FIG. 13 is a drawing showing the configuration of the light-source luminance controller 213. The light-source luminance controller 213 has a cumulative light-emission amount calculator 2131, a maximum cumulative light-emission amount calculator 2132, a difference calculator 2133, and a light-source luminance correcting unit 2134.

The basic configuration thereof is similar to that of the first embodiment. The cumulative light-emission amount calculator 2131 calculates the cumulative light-emission amount of each of the plurality of light sources. Then, the maximum cumulative light-emission amount calculator 2132 obtains a maximum cumulative light-emission amount indicating the maximum value of the cumulative light-emission amount of each of the plurality of light sources. The difference calculator 2133 compares the maximum cumulative light-emission amount with the reference light-emission amount determined in advance. Specifically, the difference calculator 2133 obtains the difference between the maximum cumulative light-emission amount and the reference light-emission amount. Details of each of the units will be explained below in detail.

The cumulative light-emission amount calculator 2131 calculates the cumulative light-emission amount of the light-source luminance of each of the plurality of light sources. The method of calculating the cumulative light-emission amount is configured to obtain the amount by an infinite impulse response (IIR) filter as well as the first embodiment. The cumulative light-emission amount of each of the light sources according to the IIR filter is obtained by Expression 10.

$$F(i,t)=\alpha\cdot I(i,t)+(1-\alpha)\cdot F(i,t-1) \quad \text{[Expression 10]}$$

In the expression, "I(i,t)" represents the light-source luminance of the i-th light source at time "t" calculated by the light-source luminance calculator 211, "F(i,t)" represents the cumulative light-emission amount of the i-th light source at the time "t", and "α" represents a coefficient which determines the characteristics of the IIR filter. The cumulative light-emission amount of each of the plurality of light sources obtained by Expression 10 is transmitted to the maximum cumulative light-emission amount calculator 2132.

In the above description, the cumulative light-emission amount of each of the light sources is configured to be obtained by using the light-source luminance. However, the cumulative light-emission amount of each of the light sources may be configured to be obtained after the convolution calculation result (weighted linear sum) of the luminance of the light source and the luminance of the light sources in the periphery thereof. This is for the reason that the temperature change of the light source is affected by the temperature change caused by the light emission of the light source in the periphery thereof in addition to the temperature change caused by the light emission of the light source which is the target for obtaining the cumulative light-emission amount.

Figure 14:
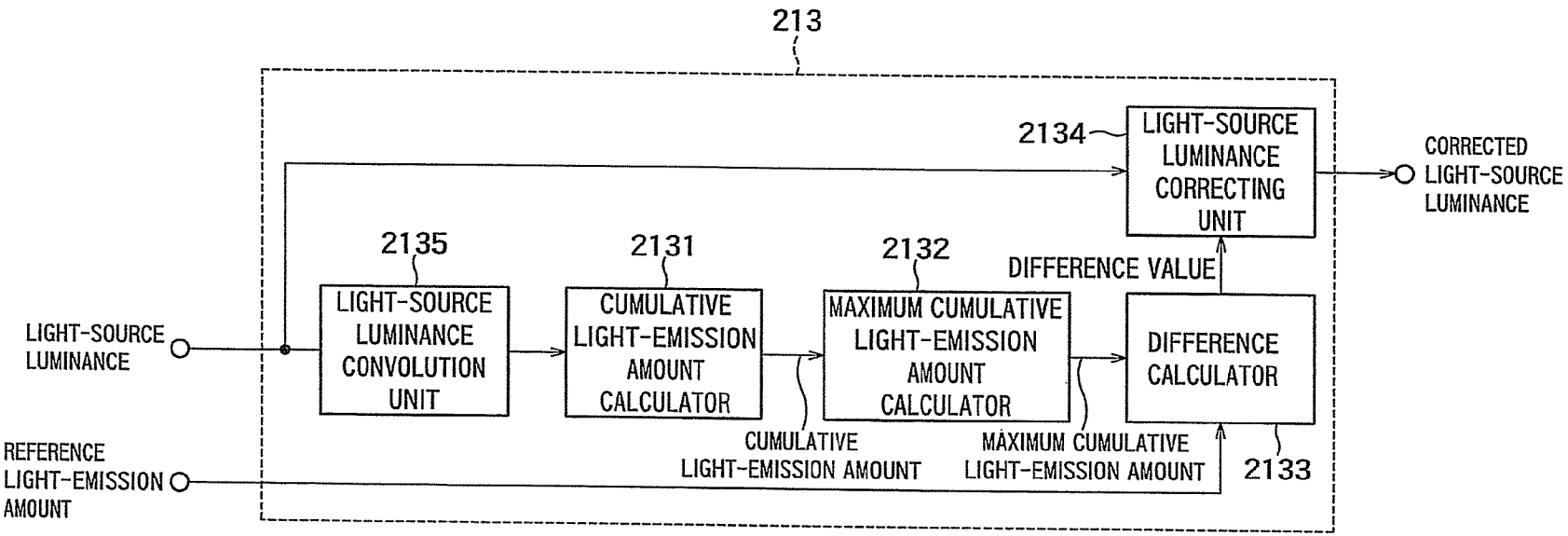
FIG. 14 is a drawing showing the configuration of a modification example of the light-source luminance controller of the second embodiment.

FIG. 14 shows the configuration of the light-source luminance controller 213 of the case in which a light-source luminance convolution calculator 2135 is added. First, the luminance of each of the light sources is input to the light-source luminance convolution calculator 2135. Then, the light-source luminance is subjected to a convolution calculation by using a coefficient set in advance depending on the magnitude of the temperature influence on the peripheral light source when a certain light source emits light. For example, if a peripheral light source is emitting light even if a certain light source is turned off, part of the luminance of the peripheral light source is added to the luminance of the light source serving as a processing target, the light source of the processing target virtually emits light, and the influence caused by the light emission of the peripheral light source can be taken into consideration. The cumulative light-emission amount is obtained after carrying out the convolution calculation with respect to the light-source luminance in the above describe manner.

The range of the light source(s) to be subjected to the convolution calculation may be the peripheral light source(s) that exerts temperature influence on the light source of the processing target. However, as another configuration, the convolution calculation may be configured to be carried out in the range of the light sources using the same drive circuit, for emitting light of the light sources. For example, the light sources of the upper two rows of FIG. 10 are emitting light by a common drive circuit, and the light sources of the lower two rows are emitting light by another common drive circuit; in this case, the light sources of the upper two rows are subjected to the convolution calculation by the range of the light sources of the upper two rows, and the light sources of the lower two rows are configured to be subjected to the convolution calculation by the range of the light sources of the lower two rows. When such a configuration is employed, temperature increase of the drive circuits can be suppressed.

The maximum cumulative light-emission amount calculator 2132 obtains the maximum cumulative light-emission amount indicating the maximum value of the cumulative light-emission amount of each of the plurality of light sources and transmits the amount to the difference calculator 2133.

The difference calculator 2133 calculates the difference value indicating the difference between the reference light-emission amount and the maximum cumulative light-emission amount and transmits the difference value to the light-source luminance correcting unit 2134.

As well as the first embodiment, the light-source luminance correcting unit 2134 calculates a light-source luminance correction coefficient based on the difference value and corrects the light-source luminance of the plurality of light sources by using the light-source luminance correction coefficient. The correction of the light-source luminance is calculated in the manner of Expression 11.

$$I'(i,t)=G_c\cdot I(i,t) \quad \text{[Expression 11]}$$

In the expression, "I'(i,t)" represents the corrected light-source luminance of the i-th light source.

The corrected light-source luminance of each of the plurality of light sources 223 obtained in the above described manner is transmitted to the timing controller 214.

According to the present embodiment, an image processing apparatus and an image displaying apparatus provided with the image processing apparatus which suppress deterioration and temperature increase of a light source as much as possible when light emission is continued for a long period of time n a high light-source luminance state can be provided.

The embodiments of a transmission-type liquid crystal displaying apparatus in which a liquid crystal panel and a backlight are combined as the configuration of a displaying unit have been explained. However, the present invention can be applied to the configurations of various displaying units other than the transmission-type liquid crystal displaying apparatus. For example, the present invention can be also applied to a projection-type displaying unit in which a liquid crystal panel which modulates light and a light source such as a halogen light source are combined. Alternatively, the present invention may be applied to a projection-type displaying unit utilizing a halogen light source as a light source unit and a digital micro mirror device, which displays images by controlling reflection of the light from the halogen light source, as a light modulating element.

The invention claimed is:

1. An image displaying apparatus having a backlight to emit light and a liquid crystal panel to display an image in a display region by modulating light from the backlight, comprising:

a light-source luminance calculator configured to calculate light-source luminance of the light emitted by the backlight based on pixel values of an input image;

a gray level converting unit configured to convert gray levels of the input image based on the light-source luminance to a converted image;

a cumulative light-emission amount calculator configured to calculate a cumulative light-emission amount by summing up light-source luminance for an arbitrary period for which an image is displayed at a time before the input image is displayed;

a comparing unit configured to compare the cumulative light-emission amount with a reference light-emission amount determined in advance;

a light-source luminance correcting unit configured to correct the light source luminance to a smaller value when the difference between the cumulative light-emission amount and the reference light-emission amount is smaller than a reference to obtain corrected light-source luminance; and a controller configured to carry out control to write the converted image to the liquid crystal panel and cause the backlight to emit light based on the corrected light-source luminance.

2. The image displaying apparatus according to claim 1, wherein the comparing unit obtains a difference value of the reference light-source amount and the cumulative light-emission amount; and, if the difference between the cumulative light-emission amount and the reference light-emission amount is smaller than the reference, the light-source luminance correcting unit obtains a correction coefficient whose value is reduced as the difference value is reduced and obtains the corrected light-source luminance by multiplying the light-source luminance by the correction coefficient.

3. The image displaying apparatus according to claim 1, wherein the backlight has a plurality of light sources capable of respectively controlling intensities of light;

the light-source luminance calculator calculates the light-source luminance for each of the light sources based on an input video signal in illumination regions obtained by tentatively dividing the display region based on spatial arrangement of the plurality of light sources;

the gray level converting unit carries out gray level conversion of the input image in accordance with the light-source luminance calculated for each of the light sources;

the cumulative light-emission amount calculator calculates the cumulative light-emission amount for each of the plurality of light sources and obtains a maximum value of the cumulative light-emission amount of each of the plurality of light sources;

the comparing unit compares the maximum value of the cumulative light-emission amount with the reference light-emission amount; and the apparatus comprises a light-source luminance correcting unit configured to correct the light-source luminance of the light sources to smaller values when the comparing unit determines that the difference between the maximum value of the cumulative light-emission amount and the reference light-emission amount smaller than a reference.

4. The image displaying apparatus according to claim 3, wherein the cumulative light-emission amount calculator calculates a weighted linear sum of the light-source luminance of a target light source being one of the light sources and the light-source luminance of the light source in the periphery of the target light source to obtain the cumulative light-emission amount of the target light source.

5. The image displaying apparatus according to claim 1, wherein the cumulative light-emission amount calculator calculates the cumulative light-emission amount by applying an infinite impulse response filter to the light-source luminance.

6. An image processing apparatus for providing an image to an image displaying apparatus having a backlight to emit light and a liquid crystal panel to display the image in a display region by modulating light from the backlight, comprising:

a light-source luminance calculator configured to calculate light-source luminance of the light emitted by the backlight based on pixel values of an input image;

a gray level converting unit configured to convert gray levels of the input image based on the light-source luminance to a converted image;

a cumulative light-emission amount calculator configured to calculate a cumulative light-emission amount by summing up light-source luminance for an arbitrary period for which an image is displayed at a time before the input image is displayed;

a comparing unit configured to compare the cumulative light-emission amount with a reference light-emission amount determined in advance;

a light-source luminance correcting unit configured to correct the light source luminance to become smaller when the difference between the cumulative light-emission amount and the reference light-emission amount is smaller than a reference to obtain corrected light-source luminance; and a controller configured to provide the converted image to the liquid crystal panel and to provide the corrected light-source luminance to the backlight.

* * * * *